US011753908B2

(12) United States Patent
Erives et al.

(10) Patent No.: US 11,753,908 B2
(45) Date of Patent: Sep. 12, 2023

(54) MULTI-ZONE SAND SCREEN WITH ALTERNATE PATH FUNCTIONALITY

(71) Applicant: Schlumberger Technology Corporation, Sugar Land, TX (US)

(72) Inventors: Valeria Erives, Houston, TX (US); Julia Huynh, Houston, TX (US); Christopher Cassidy, Pearland, TX (US); Ashutosh Dikshit, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 12 days.

(21) Appl. No.: 17/455,670

(22) Filed: Nov. 19, 2021

(65) Prior Publication Data

US 2022/0154557 A1 May 19, 2022

Related U.S. Application Data

(60) Provisional application No. 63/116,095, filed on Nov. 19, 2020.

(51) Int. Cl.
*E21B 43/04* (2006.01)
*E21B 43/08* (2006.01)

(52) U.S. Cl.
CPC ..... *E21B 43/04* (2013.01); *E21B 43/08* (2013.01)

(58) Field of Classification Search
CPC ..... E21B 43/04; E21B 43/08
(Continued)

(56) References Cited

U.S. PATENT DOCUMENTS 5,921,318 A 7/1999 Ross
6,446,729 B1 9/2002 Bixenman et al.
(Continued)

FOREIGN PATENT DOCUMENTS

EP 2184436 A2 5/2010
EP 2631423 A1 8/2013
(Continued)

OTHER PUBLICATIONS

International Search Report and Written Opinion issued in PCT Application PCT/US2021/026104 dated Aug. 2, 2021 (12 pages).
(Continued)

*Primary Examiner* — Zakiya W Bates
*Assistant Examiner* — Ashish K Varma
(74) *Attorney, Agent, or Firm* — Matthew Goode

(57) ABSTRACT

A screen assembly. The screen assembly may include an inner tubular, a filter screen, a shunt tube, and a perforated shroud. The inner tubular may be configured to flow a formation fluid produced at a first production zone of a formation having multiple production zones that is downhole of the screen assembly. The filter screen may be disposed radially outward from the inner tubular and configured to filter a formation fluid produced at a second production zone that is proximate the screen assembly prior to the formation fluid entering an annulus between the filter screen and the inner tubular. The shunt tube may be disposed radially outward from the filter screen to flow a fluid to a location within the borehole that is downhole of the screen assembly. The perforated shroud may be perforated shroud disposed radially outward from the shunt tube.

20 Claims, 3 Drawing Sheets

(58) Field of Classification Search
USPC ..... 166/278
See application file for complete search history.

(56) References Cited

U.S. PATENT DOCUMENTS

| | | | | |
|---|---|---|---|---|
| 6,681,854 | B2 | 1/2004 | Danos | |
| 6,684,952 | B2 | 2/2004 | Brockman et al. | |
| 7,165,618 | B2 | 1/2007 | Brockman et al. | |
| 7,562,709 | B2 | 7/2009 | Saebi et al. | |
| 7,918,276 | B2 | 4/2011 | Guignard et al. | |
| 8,127,845 | B2 | 3/2012 | Assal | |
| 8,496,055 | B2 | 7/2013 | Mootoo et al. | |
| 8,511,380 | B2 * | 8/2013 | Guignard | E21B 43/08 166/227 |
| 8,988,178 | B2 | 3/2015 | Deville et al. | |
| 9,000,873 | B2 | 4/2015 | Deville et al. | |
| 9,638,012 | B2 | 5/2017 | Yeh et al. | |
| 2002/0117301 | A1 | 8/2002 | Womble | |
| 2002/0189809 | A1 | 12/2002 | Nguyen et al. | |
| 2002/0195253 | A1 | 12/2002 | Hill, Jr. et al. | |
| 2009/0025923 | A1 | 1/2009 | Patel et al. | |
| 2014/0034336 | A1 * | 2/2014 | Jasek | E21B 43/04 166/387 |
| 2015/0047837 | A1 | 2/2015 | Turner et al. | |
| 2015/0053408 | A1 | 2/2015 | Purkis et al. | |
| 2015/0198016 | A1 | 7/2015 | Langlais | |
| 2015/0315895 | A1 | 11/2015 | Patel et al. | |
| 2017/0241214 | A1 | 8/2017 | Billingham | |
| 2017/0342810 | A1 * | 11/2017 | Richards | E21B 43/08 |
| 2021/0123327 | A1 * | 4/2021 | Langlais | E21B 17/1078 |
| 2021/0363862 | A1 | 11/2021 | Langlais | |

FOREIGN PATENT DOCUMENTS

| | | | |
|---|---|---|---|
| EP | 2899367 | A2 | 7/2015 |
| WO | 2007092082 | A2 | 8/2007 |
| WO | 2009061542 | A1 | 5/2009 |
| WO | 2011011306 | A1 | 1/2011 |
| WO | 2017155546 | A1 | 9/2017 |
| WO | 2018187854 | A1 | 10/2018 |
| WO | 2019246501 | A1 | 12/2019 |
| WO | 2020172466 | A1 | 8/2020 |
| WO | 2020206211 | A1 | 10/2020 |
| WO | 2021207304 | A1 | 10/2021 |
| WO | 2021211664 | A1 | 10/2021 |

OTHER PUBLICATIONS

International Search Report and Written Opinion issued in PCT Application PCT/US2021/027205 dated Jul. 14, 2021 (12 pages).

* cited by examiner

MULTI-ZONE SAND SCREEN WITH ALTERNATE PATH FUNCTIONALITY

CROSS REFERENCE TO RELATED APPLICATIONS

The present application claims priority benefit of U.S. Provisional Application No. 63/116,095 filed Nov. 19, 2020, the entirety of which is incorporated by reference herein and should be considered part of this specification.

BACKGROUND

Gravel packing is one method for controlling sand production. Although there are variations, gravel packing usually involves placing a sand screen around the section of the production string containing the production inlets. This section of the production string is aligned with perforations. Gravel slurry, which is typically gravel particulates carried in a viscous transport fluid, is pumped through the tubing into the formation and the annulus between the sand screen and the casing or between the sand screen and the open hole. The deposited gravel holds the sand in place preventing the sand from flowing to the production tubing while allowing the production fluids to be produced therethrough.

It has become common for oil and gas wells to incorporate multiple production zones. The most common method of reaching multiple production zones is through deviated and horizontal wells. In some of these wells, sand can collapse or throttle the hydrocarbon production and, therefore, a gravel pack operation is performed. Gravel packing wells proves to be a technical challenge especially having the gravel reach the furthest zones. In addition, because there are multiple zones, segregating production from each zone to prevent hydrocarbons from leaking into the formation is desirable.

Accordingly, there is a need for a screen design, which allows for extended gravel packing techniques, while also enabling production from multiple zones.

SUMMARY

A screen assembly according to one or more embodiments of the present disclosure includes an inner tubular, a filter screen, a shunt tube, and a perforated shroud. The inner tubular is configured to flow a formation fluid produced at a first production zone of a formation having multiple production zones that is downhole of the screen assembly. The filter screen is disposed radially outward from the inner tubular and configured to filter a formation fluid produced at a second production zone that is proximate the screen assembly prior to the formation fluid entering an annulus between the filter screen and the inner tubular. The shunt tube is disposed radially outward from the filter screen to flow a fluid to a location within the borehole that is downhole of the screen assembly. The perforated shroud is perforated shroud disposed radially outward from the shunt tube.

A gravel pack system according to one or more embodiments of the present disclosure includes a first screen assembly, a second screen assembly that, when the gravel pack system is positioned within the borehole, is uphole of the first screen assembly, and a jumper tube. The first screen assembly includes a first inner tubular, a first filter screen, a first shunt tube, and a first perforated shroud. The first inner tubular is configured to flow a first formation fluid produced at a first production zone of a formation having multiple production zones that is downhole of the first screen assembly. The first filter screen is disposed radially outward from the first inner tubular and configured to filter a second formation fluid produced at a second production zone that is proximate the first screen assembly prior to the second formation fluid entering a first annulus between the first filter screen and the first inner tubular. The first shunt tube is disposed radially outward from the first filter screen to flow a fluid to a location within the borehole that is downhole of the first screen assembly. The first perforated shroud is disposed radially outward from the first shunt tube. The second screen assembly includes a second inner tubular, a second filter screen, a second shunt tube, and a second perforated shroud. The second inner tubular is configured to flow at least one of the first formation fluid, the second formation fluid, or a third formation fluid produced at a third production zone that is downhole of the second screen assembly. The second filter screen is disposed radially outward from the second inner tubular and configured to filter a fourth formation fluid produced at a fourth production zone that is proximate the second screen assembly prior to the fourth formation fluid entering a second annulus between the second filter screen and the second inner tubular. The second shunt tube is disposed radially outward from the second filter screen to flow the fluid to the location within the borehole that is downhole of the first screen assembly. The second perforated shroud is disposed radially outward from the shunt tube. The jumper tube is in fluid communication with and extends between the first shunt tube and the second shunt tube.

A method for producing formation fluids from a multiple zone formation according to one or more embodiments of the present disclosure includes flowing a gravel slurry through a first shunt tube of a first screen assembly. The method also includes flowing a first formation fluid produced at a first production zone that is downhole of the first screen assembly through an inner tubular of the first screen assembly. The method further includes filtering a second formation fluid produced at a second production zone that is proximate the first screen assembly via a first filter screen of the first screen assembly. The method also includes flowing the filtered second formation fluid through a first annulus between the first filter screen and the first inner tubular.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

One or more embodiments of the present disclosure are directed to a screen design for multi-zone, long reach gravel packing applications. In the screen design according to one or more embodiments of the present disclosure, the inflowing fluid is isolated from the main production tubing and is later combined in a flow control device that can be closed, throttled, or choked based on the desired and/or actual production rate of a specific zone.

Moreover, the screen design according to one or more embodiments of the present disclosure enables long reach gravel capabilities by including multiple transport and packing tubes, which allows the gravel to be transported and ejected further than a typical gravel packing process, for example.

Figure 1:
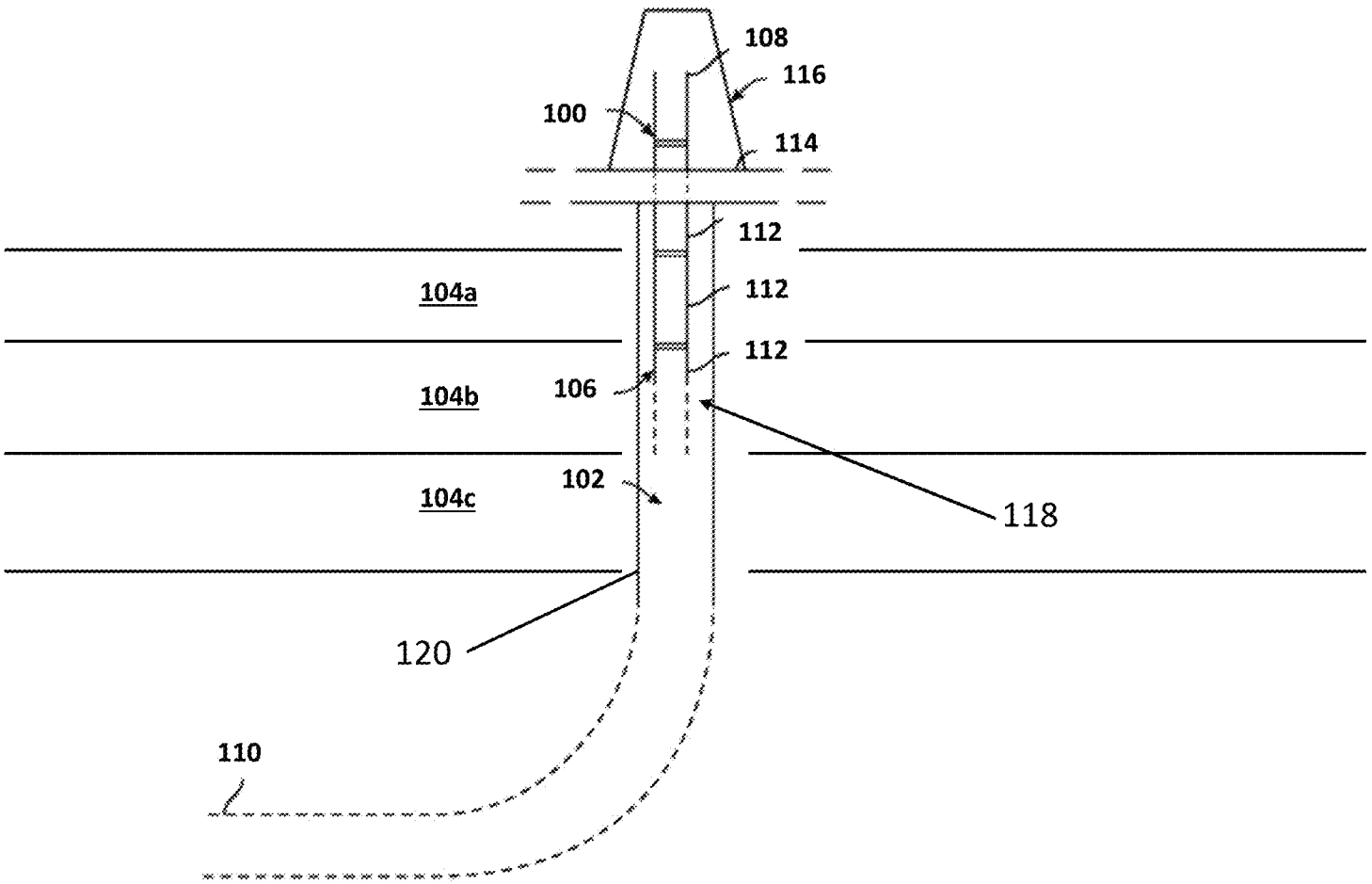
FIG. 1 is a schematic view of a gravel packing system according to one or more embodiments of the present disclosure.

Referring now to FIG. 1, FIG. 1 is a gravel pack system 100 deployed in a borehole 102 extending through multiple production zones 104*a*, 104*b*, 104*c* of a formation according to one or more embodiments of the present disclosure. In this example, gravel pack system 100 includes a gravel packing completion 106 deployed downhole into borehole 102 on a tubing string 108. The gravel packing completion 106 is deployed to a desired gravel packing zone 110 to facilitate formation of a gravel pack. By way of example, the gravel packing completion 106 may be a multistage completion and/or an alternate path completion.

In the embodiment illustrated, the gravel packing completion 106 comprises a plurality of screen assemblies 112, coupled together along the tubing string 108 on a rig floor 114 and deployed downhole into the borehole 102 and into the gravel packing zone 110. The screen assemblies 112 may be spaced along the tubing string 108 such that one screen assembly 112 is located in each of the production zones 104*a*, 104*b*, 104*c*. In other embodiments, two or more screen assemblies 112 may be located in a single production zone 104*a*, 104*b*, 104*c*.

The deployment of the tubing string 108 downhole may be facilitated via a rig 116. In one or more embodiments, the screen assemblies 112 are coupled together along the tubing string 108 and disposed at gravel packing zone 110 to enable formation of a gravel pack. The gravel pack may be formed in an annulus 118 generally between a surrounding borehole wall 120 and the gravel packing completion 106.

Figure 2:
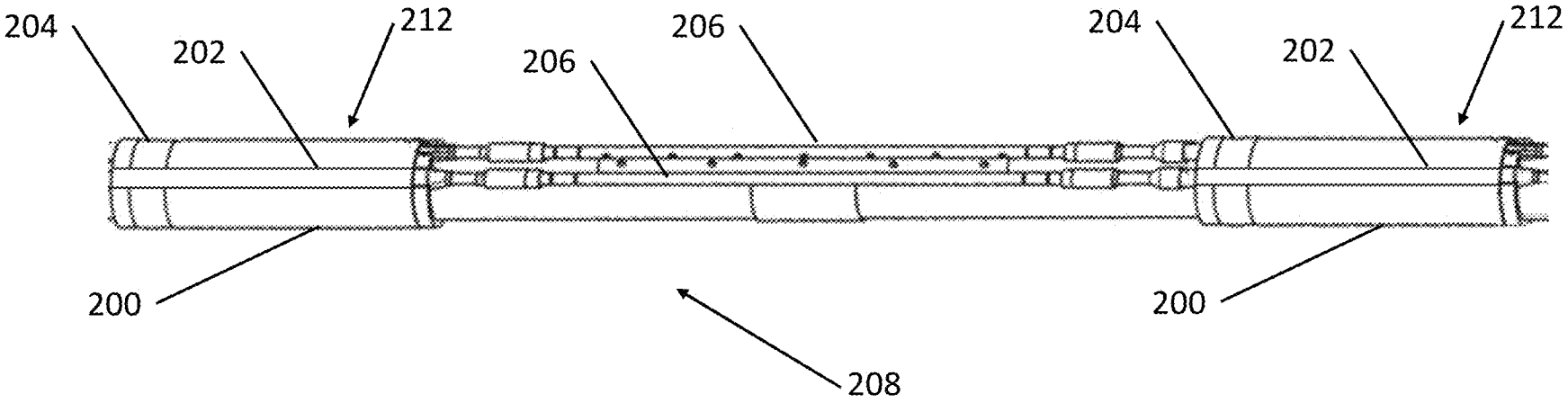
FIG. 2 is a portion of a tubing string according to one or more embodiments of the present disclosure.

Turning now to FIG. 2, FIG. 2 is a portion of a tubing string 208 according to one or more embodiments of the present disclosure. As shown in FIG. 2, the tubing string 208 includes two screen assemblies 212 positioned along the tubing string 208. Each screen assembly 212 is covered by a shroud 200, as described in more detail below, that prevents large particles from entering the screen assembly 212. According to one or more embodiments, the shroud 200 also includes a channel 202 formed in a portion of the shroud. The channel 202 allows control lines to be positioned within the outer diameter of the screen assembly 212 to prevent damage to the control lines as the tubing string 208 is positioned within the borehole.

Flow control devices 204, e.g., valves, are positioned upstream of each of the screen assemblies 212. Although the flow control devices 204 are shown as coupled to the screen assemblies 212, the invention is not thereby limited. One or both of flow control devices 204 may be positioned apart from the screen assemblies 212 and be in fluid communication with the screen assemblies via tubing, piping, or similar means known to those skilled in the art. As described in more detail below, the flow control devices 204 combine and/or control the flow of the formation fluids flowing through the screen assemblies 212.

As shown in FIG. 2, the screen assemblies 212 are in fluid communication via jumper tubes 206. Specifically, one or more shunt tubes, described in more detail below, that extend through the screen assemblies 212 are in fluid communication via the jumper tubes 206. According to one or more embodiments, the shunt tubes transport gravel slurry through the screen assemblies 212 during gravel packing and the jumper tubes 206 carry the gravel slurry from the shunt tubes of a first screen assembly 212 to a second screen assembly 212, for example.

Although only two screen assemblies are shown, the invention is not thereby limited. A tubing string 208 may have one, three, or more screen assemblies 212 positioned along the length of the tubing string 208. Additionally, although two jumper tubes 206 are shown, screen assemblies 212 may include one, three, or more shunt tubes in fluid communication with shunt tubes of an adjacent screen assembly 212 via jumper tubes 206. Additionally, a jumper tube may be used to direct the gravel slurry into the annulus between the tubing string 208 and the borehole wall or the gravel slurry may flow into the annulus from the shunt tube of a screen assembly 212.

Figure 3:
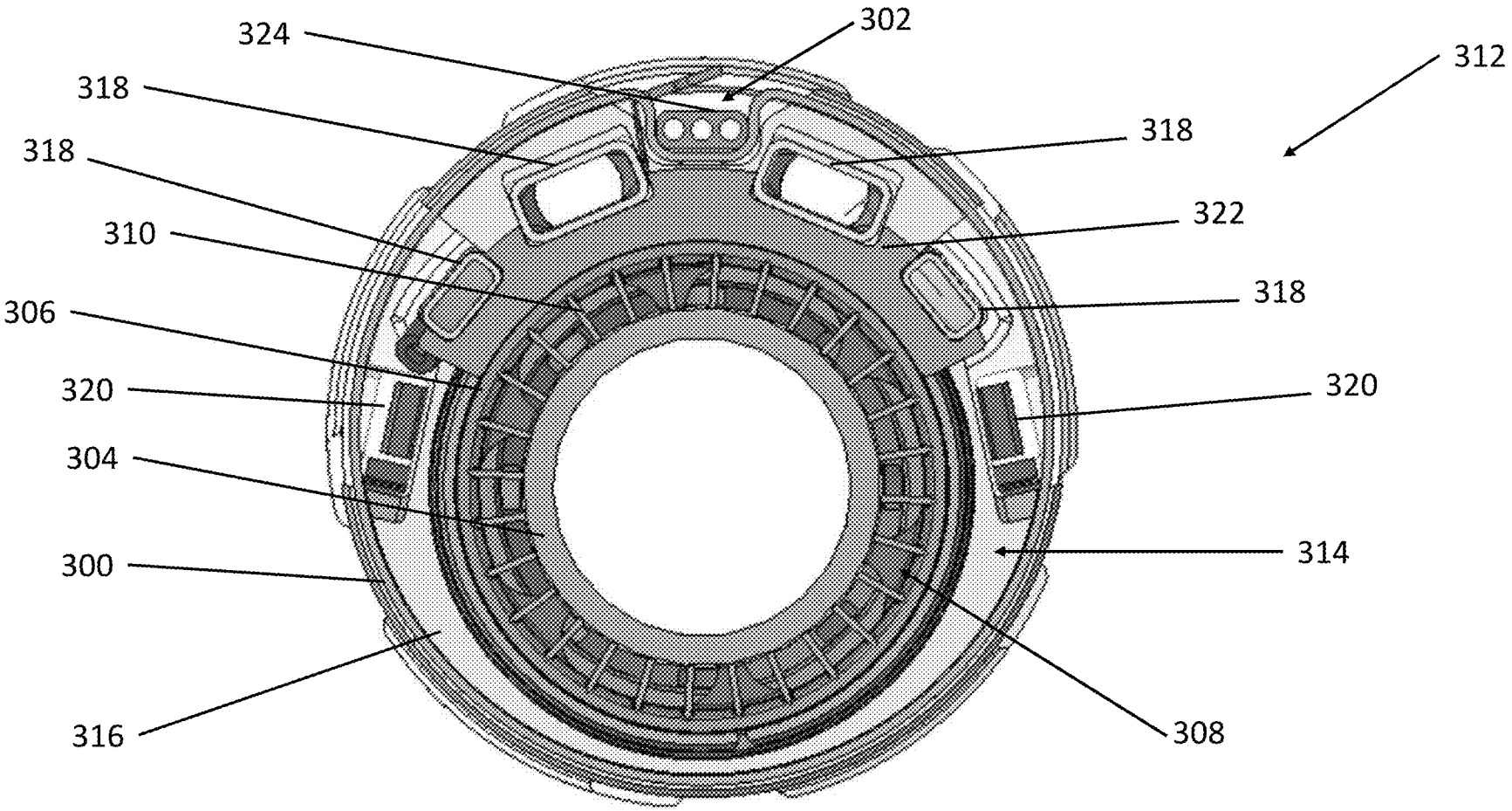
FIG. 3 is a cross-sectional view of a screen assembly according to one or more embodiments of the present disclosure.

Turning now to FIG. 3, FIG. 3 is a cross-sectional view of a screen assembly 312 according to one or more embodiments of the present disclosure. The screen assembly includes an inner tubular 304 and a filter screen 306, e.g., a wire screen, disposed radially outward from the inner tubular 304, creating a first annulus 308 within the screen assembly 312. Spacers 310, braces, or similar structures may be positioned in the annulus 308 between the inner tubular 304 and the filters screen 306 to maintain the position of the inner tubular 304 within the filter screen 306.

A shroud 300 is disposed radially outward from the filter screen 306, creating a second annulus 314. On a first end of the screen assembly 312, the shroud 300, the filter screen 306, and/or the inner tubular 304 are coupled to a manifold and/or a bracket 316 at either end to secure the shroud 300 on the screen assembly 312. The manifold or bracket 316 may also support and maintain the position of shunt tubes 318, such as packing tubes and transport tubes and leak-off tubes 320. Intermediate brackets 322 may be positioned along the length of the screen assembly 312 to support and maintain the position of shunt tubes 318, leak-off tubes 320, and/or the shroud 300.

As discussed above, the shunt tubes 318 transport gravel slurry to the desired location within the borehole. The leak-off tubes 320 help dehydrate the gravel slurry once it has been placed within the borehole. In some embodiments, the shunt tubes and/or leak-off tubes may be omitted based on the requirements of the tubing string and screen assembly 312. As discussed above, a channel 302 may be formed into the shroud 300 that allows control lines 324 to be positioned within the outer diameter of the screen assembly 312 to prevent damage to the control lines 324 as the tubing string is positioned within the borehole.

Referring back to FIG. 1, with continued reference to FIG. 3, in operation, a first formation fluid is produced from a production zone 104*a*, 104*b*, 104*c* that is downhole of a screen assembly 312. The first formation fluid enters a tubing string 108 and travels uphole towards the rig floor 114. As the first formation fluid nears the screen assembly 312, it enters the inner tubular 304 via a valve (not shown) or similar flow control device and passes through the screen assembly 312.

As the first fluid is flowing through the inner tubular 304 of the screen assembly 312, a second fluid is produced from a production zone 104*a*, 104*b*, 104*c* that is proximate the screen assembly 312. The second formation fluid passes through the shroud 300 and the filter screen 306, which filters out formation particles such as sand. The filtered second formation fluid then enters the annulus 308 between the inner tubular 304 and the filter screen 306 and travels uphole.

A flow control device, for example the flow control device 204 shown in FIG. 2, controls the flow of the first formation fluid and the second formation fluid traveling uphole from the screen assembly 312. The flow control device may also combine a portion or all of the first formation fluid and a portion or all of the formation fluid to form a combined formation fluid, which then travels uphole via the tubing string 108. This combined formation fluid may travel through the inner tubular of a second screen assembly 312, where it is combined with a third formation fluid flowing through the filter screen 306 of the second screen assembly 312 to form a second combined formation fluid.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A screen assembly for use in a borehole extending through a formation having multiple production zones, the screen assembly comprising:

an inner tubular for flowing a formation fluid produced at a first production zone that is downhole of the screen assembly;

a filter screen disposed radially outward from the inner tubular and configured to filter a formation fluid produced at a second production zone that is proximate the screen assembly prior to the formation fluid entering an annulus between the filter screen and the inner tubular;

a shunt tube disposed radially outward from the filter screen to flow a fluid to a location within the borehole that is downhole of the screen assembly;

a perforated shroud disposed radially outward from the shunt tube; and wherein the formation fluid produced at the first production zone is isolated from the formation fluid produced at the second production zone within the screen assembly.

2. The screen assembly of claim 1, further comprising a leak-off tube.

3. The screen assembly of claim 1, wherein the shunt tube comprises at least one of a packing tube or a transport tube.

4. The screen assembly of claim 1, wherein a channel is formed in the perforated shroud to receive control lines.

5. The screen assembly of claim 1, wherein the filter screen comprises a wire screen.

6. A gravel pack system for use in a borehole extending through a formation having multiple production zones, the gravel pack system comprising:

a first screen assembly comprising:

a first inner tubular for flowing a first formation fluid produced at a first production zone that is downhole of the first screen assembly;

a first filter screen disposed radially outward from the first inner tubular and configured to filter a second formation fluid produced at a second production zone that is proximate the first screen assembly prior to the second formation fluid entering a first annulus between the first filter screen and the first inner tubular;

a first shunt tube disposed radially outward from the first filter screen to flow a fluid to a location within the borehole that is downhole of the first screen assembly; and a first perforated shroud disposed radially outward from the first shunt tube;

a second screen assembly that, when the gravel pack system is positioned within the borehole, is uphole of the first screen assembly, the second screen assembly comprising:

a second inner tubular for flowing at least one of the first formation fluid, the second formation fluid, or a third formation fluid produced at a third production zone that is downhole of the second screen assembly;

a second filter screen disposed radially outward from the second inner tubular and configured to filter a fourth formation fluid produced at a fourth production zone that is proximate the second screen assembly prior to the fourth formation fluid entering a second annulus between the second filter screen and the second inner tubular;

a second shunt tube disposed radially outward from the second filter screen to flow the fluid to the location within the borehole that is downhole of the first screen assembly; and a second perforated shroud disposed radially outward from the shunt tube; and a jumper tube in fluid communication with and extending between the first shunt tube and the second shunt tube.

7. The gravel pack system of claim 6, further comprising a flow control device positioned between the first screen assembly and the second screen assembly, the flow control device operable to combine the first formation fluid and the second formation fluid to form a combined formation fluid.

8. The gravel pack system of claim 7, wherein the flow control device is further operable to control the flow of control of at least one of the first formation fluid, the second formation fluid, or the combined formation fluid.

9. The gravel pack system of claim 6, further comprising a flow control device that, when the gravel pack system is positioned within the borehole, is uphole of the second screen assembly, the flow control device operable to at least one of combine at least two of the first formation fluid, the second formation fluid, the third formation fluid, or the fourth formation fluid to form a combined formation fluid.

10. The gravel pack system of claim 9, wherein the flow control device is further operable to control the flow of at least one of the first formation fluid, the second formation fluid, the third formation fluid, the fourth formation fluid, or the combined formation fluid.

11. The gravel pack system of claim 6, wherein at least one of the first screen assembly or the second screen assembly further comprises a leak-off tube.

12. The gravel pack system of claim 6, wherein the first shunt tube and the second screen assembly each comprise at least one of a packing tube or a transport tube.

13. The gravel pack system of claim 6, wherein a channel is formed in at least one of the first perforated shroud or the second perforated shroud to receive control lines.

14. The gravel pack system of claim 6, wherein at least one of the first filter screen or the second filter screen comprises a wire screen.

15. A method for producing formation fluids from a multiple zone formation, the method comprising:

flowing a gravel slurry through a first shunt tube of a first screen assembly;

flowing a first formation fluid produced at a first production zone that is downhole of the first screen assembly through an inner tubular of the first screen assembly; and filtering a second formation fluid produced at a second production zone that is proximate the first screen assembly via a first filter screen of the first screen assembly; and flowing the filtered second formation fluid through a first annulus between the first filter screen and the first inner tubular, wherein the first formation fluid is isolated from the filtered second formation fluid within the screen assembly.

16. The method of claim 15, further comprising flowing at least one of the first formation fluid, the second formation fluid, or a third formation fluid produced at a third production zone that is downhole of a second screen assembly through a second inner tubular of a second screen assembly.

17. The method of claim 16, further comprising filtering a fourth formation fluid produced at a fourth production zone that is proximate the second screen assembly via a second filter screen of the first screen assembly.

18. The method of claim 17, further comprising flowing the filtered fourth formation fluid through a second annulus between the second filter screen and the second inner tubular.

19. The method of claim 15, further comprising flowing the gravel slurry through a second shunt tube of a second screen assembly in fluid communication with the first shunt tube via a jumper tube extending between the first shunt tube and the second shunt tube.

20. The method of claim 15, further comprising combining the first formation fluid and the second formation fluid within a flow control device located uphole of the first screen assembly to form a combined formation fluid.

* * * * *